US005131877A

United States Patent [19]

Mathumoto

[11] Patent Number: 5,131,877

[45] Date of Patent: Jul. 21, 1992

[54] ELECTROLUMINESCENT DEVICE

[75] Inventor: Toru Mathumoto, Miyagi, Japan

[73] Assignee: Alps Electric Co., Ltd., Tokyo, Japan

[21] Appl. No.: 591,584

[22] Filed: Oct. 2, 1990

[30] Foreign Application Priority Data

Oct. 12, 1989 [JP] Japan ..... 1-118725[U]

[51] Int. Cl.[5] ..... H05B 33/10; H05B 33/02

[52] U.S. Cl. ..... 445/24; 427/66; 313/505

[58] Field of Search ..... 313/503, 505, 509, 510, 313/511, 512; 315/169.3; 445/24; 427/66; 156/67

[56] References Cited

U.S. PATENT DOCUMENTS 3,312,852 4/1967 Motson ..... 313/510
3,504,214 3/1970 Lake et al. ..... 313/510 X
3,514,825 6/1970 Vodicka ..... 29/25.18

*Primary Examiner*—Sandra L. O'Shea

*Attorney, Agent, or Firm*—Guy W. Shoup; B. Noel Kivlin

[57] ABSTRACT

An electroluminescent device incorporating; a transparent electrode, a plurality of counter electrodes formed opposite to the transparent electrode, local fluorescent layers formed between the transparent electrode and the counter electrodes in a predetermined arrangement corresponding to that of the counter electrodes, and a dielectric layer formed between the transparent electrodes and the counter electrodes; wherein the local fluorescent layers are made selectively to emit light by selectively applying ac electric fields between the transparent electrode and the counter electrodes, and insulating film having one side provided with a wiring lines arranged in a predetermined wiring pattern and the other side coated with an adhesive film is applied to the dielectric layer underlying the counter eletrodes with the adhesive film in contact with the counter electrodes, and the counter electrodes are connected electrically to the corresponding wiring lines with a conductive material filling through holes formed in the insulating film, respectively.

2 Claims, 1 Drawing Sheet

ELECTROLUMINESCENT DEVICE

BACKGROUND OF THE INVENTION

1. Field of the Invention

The present invention relates to an electroluminescent device having a transparent electrode and a plurality of counter electrodes and capable of emitting light when an ac electric field is created between the transparent electrode and each counter electrode and, more particularly, to an electroluminescent device suitable for application to displaying characters, patterns or numerals as a display element.

2. Description of the Prior Art

The electroluminescent device (hereinafter abbreviated the "ELD") has been widely used as a display for various equipment. Such a display incorporating an ELD, in general, has a liquid crystal display element and uses the ELD as means for emitting background light. In recent years, there has been proposed a display or a level meter, which uses light emitted by an ELD directly for displaying patterns or indicating time.

When the ELD is used as a display element, the electroluminescent segments of the ELD must be activated selectively by applying an electric field through a wiring pattern across a transparent electrode and selected counter electrodes. Generally, an insulating overcoating layer is formed by printing over the counter electrodes and the wiring pattern is formed by printing on the insulating overcoating layer.

In forming the wiring pattern on the overcoating layer, the overcoating layer must be printed in regions other than those corresponding to the counter electrodes, and then the wiring pattern must be formed in the regions corresponding to the counter electrodes. Such a procedure requires complicated manufacturing processes and increases the cost of the ELD. Furthermore, since the overcoating layer cannot be formed in a thickness sufficient for the dielectric insulation of the counter electrodes from the wiring pattern, a weak electric field is applied to portions of the fluorescent layer corresponding to the wiring pattern to cause the portions of the fluorescent layer to become dimly luminous in the shape of the wiring pattern.

SUMMARY OF THE INVENTION

Accordingly, it is an object of the present invention to provide an inexpensive ELD provided with a wiring pattern and constructed so that the wiring pattern may not cause undesirable light emission.

To achieve the object, the present invention provides an ELD comprising a transparent electrode, a plurality of counter electrodes formed opposite to the transparent electrode, local fluorescent layers formed between the transparent electrode and the counter electrodes in a predetermined arrangement corresponding to that of the counter electrodes, and a dielectric layer formed between the transparent electrode and the counter electrodes.

The local fluorescent layers are made selectively to emit light by selectively applying ac electric fields between the transparent electrode and the counter electrodes, an insulating film having one side provided with wiring lines arranged in a predetermined wiring pattern and the other side coated with an adhesive film is applied to the dielectric layer underlying the counter electrodes so as to cover the counter electrodes with the side coated with the adhesive film in contact with the counter electrodes, and the counter electrodes are connected electrically through through holes formed in the insulating film to the corresponding wiring lines.

The insulating film having one side coated with the adhesive film secures a sufficient insulating distance between the wiring lines and the counter electrodes. Thus, undesired light emission due to the activation of the fluorescent layers by the wiring lines is prevented. Furthermore, the ELD of the present invention can be manufactured by simple manufacturing processes at a relatively low cost.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENT

Figure 1:
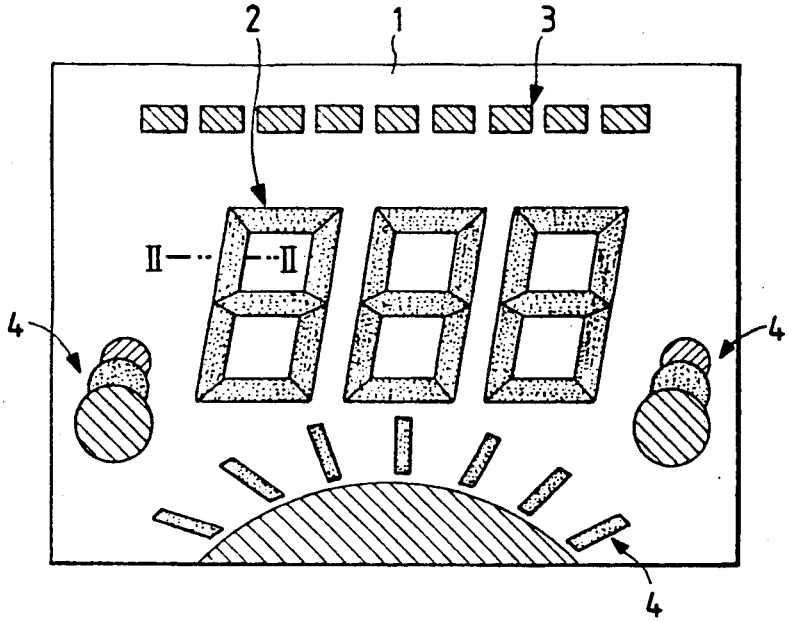
FIG. 1 is a plan view of an ELD in a preferred embodiment according to the present invention.

FIG. 1 shows an ELD embodying the present invention intended for use as a display to be placed in the central portion of the game board of a pinball game machine or the like. The ELD has a background 1 which becomes luminous in a predetermined color, and a plurality of light emitting segments arranged on the background 1. The light emitting segments become luminous respectively in different colors. The light emitting segments include display segments 2 arranged in the central area of the background 1 to display three digits, level indicating segments 3 forming a level meter arranged in the upper area of the background 1, and graphic segments 4 arranged respectively in the right-hand area, left-hand area and lower area of the background 1. In this embodiment, the background 1, the display segment 2, the level indicating segments 3 become luminous respectively in pink, orange and red. The graphic segments 4 become luminous respectively in orange, red and green. A shading pattern 7 is formed to shade boundaries between the segments that become luminous respectively in different colors.

Figure 2:
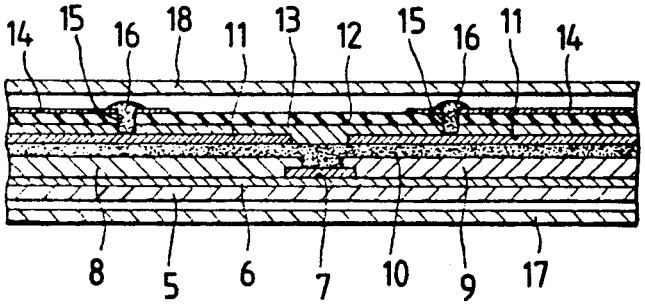
FIG. 2 enlarged sectional view taken on line II—II in FIG. 1.

Referring to FIG. 2, the surface of a base film 5 is coated entirely with a transparent electrode 6 of ITO or the like. The shading pattern 7 is formed of silver paste or the like by screen printing on the transparent electrode 6. The shading pattern consists of lines having a width in the range of 0.3 to 0.4 mm and arranged along the respective contours of the segments 2, 3 and 4. A fluorescent layer 8 that becomes luminous in pink, and a fluorescent layer 9 that becomes luminous in orange are formed by screen printing on the transparent electrode 6. The fluorescent layers 8 and 9 are spaced apart from each other by a predetermined gap on the shading pattern 7. Each of the fluorescent layer 8 and 9 is formed of a fluorescent mixture of a binding resin, fluorescent powder, and a fluorescent dye or pigment. All the light emitting areas including the background 1 and the segments 2, 3 and 4 are formed respectively of fluorescent mixtures that become luminous in different colors.

The fluorescent layers 8 and 9, and the shading pattern 7 demarcating the fluorescent layers 8 and 9 are coated with a dielectric layer 10 formed of a mixture of a binding resin having a high dielectric constant and dielectric ceramic powder. Counter electrodes 11 are formed on the dielectric layer 10 so as to correspond respectively to the fluorescent layers 8 and 9. The counter electrodes 11 are formed of, for example, silver paste by screen printing. An insulating film 12 formed of an insulating material, such as polyethylene terephthalate or polyimide, is attached adhesively with an adhesive film 13 of an adhesive, such as an acrylic adhesive or a hot melt adhesive, to the dielectric layer 10 so as to cover the counter electrodes 11. A plurality of wiring lines 14 of silver paste or a copper foil are formed in a wiring pattern respectively for the counter electrodes 11, and the counter electrodes 11 are connected electrically to the corresponding wiring lines 14 of the wiring pattern with conducters 16, such as silver paste, filled in through holes formed in the insulating fill 12 by printing. Before printing, there are no conductive layers formed on the inner surfaces of the through holes. The ELD thus constructed is sealed with a pair of sealing films 17 and 18.

Figure 3:
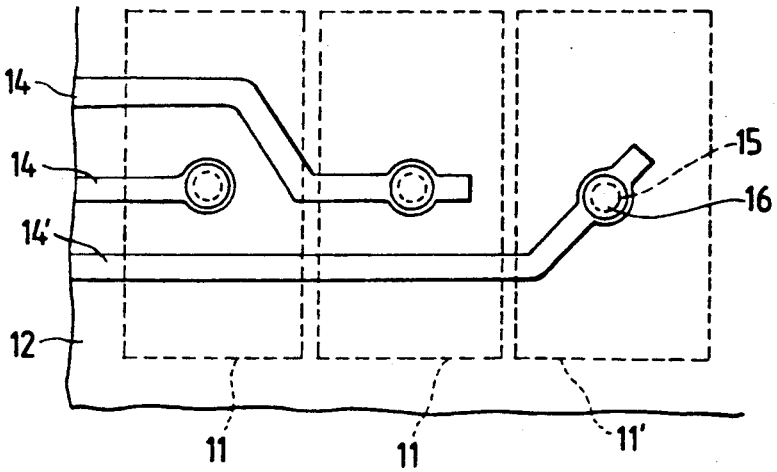
FIG. 3 is a fragmentary plan view of the ELD of FIG. 1, showing a portion of a wiring pattern.

Referring to FIG. 3, each wiring line 14 of the wiring pattern connected to the corresponding counter electrode 11 with the conductor 16 extends in one direction along the surface of the insulating film 12 across the other counter electrodes 11. The extremities of the wiring lines 14 of the wiring pattern form leads, not shown. The leads extend outside through the interface between the sealing films 17 and 18, and are connected to a driving circuit.

An ac current is supplied through the wiring line 14 to create an electric field between an optional counter electrode 11 and the transparent electrode 6. Then, a portion of the fluorescent layer corresponding to the counter electrode 11 becomes luminous in the predetermined color. For example, when the ac electric field is applied to the fluorescent layer 8, the fluorescent powder of the fluorescent layer 8 emits light to activate the fluorescent dye or the fluorescent pigment contained in the fluorescent layer 8, so that the background 1, i.e., a blank area in FIG. 1, becomes luminous in pink. Suppose that the counter electrode 11', i.e., the counter electrode on the right-hand end in FIG. 3, corresponds to the fluorescent layer 8, and the wiring line 14' is connected to the counter electrode 11'. The wiring line 14' extends across the other counter electrodes 11, i.e., the counter electrodes 11 on the left hand end and in the middle in FIG. 3, for activating the other fluorescent layers. However, since the other counter electrodes 11 and the wiring lines 14 are isolated from each other by the two insulating layers, namely, the insulating film 12 and the adhesive film 13, the other fluorescent layers are never activated by the electric field created by the current flowing through the wiring line 14'. The edge of the fluorescent layer 9 adjacent to the fluorescent layer 8 may possibly be activated by the ac electric field applied to the fluorescent layer 8. However, since the edge of the fluorescent layer 9 is covered with the shading pattern 7, the light emitted by the edge of the fluorescent layer 9 is intercepted by the shading pattern 7 and never leaks outside even if the edge of the fluorescent layer 9 is activated by the ac electric field applied to the fluorescent layer 8.

Thus, the wiring lines 14 are formed on one surface of the insulating film 12 to form a flexible, printed wiring board, the insulating film 12 is attached adhesively to the dielectric layer 10 with the adhesive film 13 so as to cover the counter electrodes 11, and then the counter electrodes 11 are connected electrically to the corresponding wiring lines 14 by filling up the through holes 15 formed in the insulating film 12. Thus, the counter electrodes 11 can be simply connected to the corresponding wiring lines 14, so that the ELD can be manufactured at a relatively low cost. Since the counter electrodes 11 and the wiring lines 14 are isolated from each other by the two insulating layers, i.e., the insulating film 12 and the adhesive film 13, a sufficient insulating distance is secured between the counter electrodes 11 and the wiring lines 14, so that areas of the display surface of the ELD other than those corresponding to the energized counter electrodes 11 do not become luminous unnecessarily in the pattern of the wiring lines 14.

Naturally, the shapes of the background 1 and the display segments 2, 3 and 4 need not be limited to those in this embodiment; the display segments may be formed, for example, in an arrangement for time indication.

Although the present invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A method for manufacturing an electroluminescent device comprising in sequence the steps of:

(1) forming a plurality of fluorescent layers on a transparent electrode by a screen printing;

(2) forming a dielectric layer on said plurality of fluorescent layers;

(3) forming a plurality of counter electrodes corresponding to said plurality of fluorescent layers on said dielectric layer by a printing operation;

(4) adhering an insulation film having a plurality of holes formed thereon said plurality of counter electrode layers by an adhesive agent; and (5) forming conductive paths between said plurality of counter electrodes and a wiring pattern by printing conductors.

2. The method of claim 1 wherein step (4) of the sequence comprises:

(4) adhering an insulation film having a wiring pattern and a plurality of holes formed thereon on said plurality of counter electrode layers by an adhesive agent.

* * * * *

UNITED STATES PATENT AND TRADEMARK OFFICE

CERTIFICATE OF CORRECTION

PATENT NO. : 5,131,877
DATED : July 21, 1992
INVENTOR(S) : Mathumoto

It is certified that error appears in the above-identified patent and that said Letters Patent is hereby corrected as shown below:

Col. 4 line 49:

after "thereon" insert --on--.

Signed and Sealed this

Twenty-fourth Day of August, 1993

*Attest:*

*Attesting Officer*

BRUCE LEHMAN

*Commissioner of Patents and Trademarks*